US009938683B2

(12) United States Patent
Myrland et al.

(10) Patent No.: US 9,938,683 B2
(45) **Date of Patent: *Apr. 10, 2018**

(54) TAMPING TOOL

(71) Applicant: Beacon Athletics, Inc., Middleton, WI (US)

(72) Inventors: James W. Myrland, Bellevue, WI (US); Jeffrey Claire Jenkins, Verona, WI (US)

(73) Assignee: Beacon Athletics, Inc., Middleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/791,855

(22) Filed: Oct. 24, 2017

(65) Prior Publication Data

US 2018/0044873 A1 Feb. 15, 2018

Related U.S. Application Data

(63) Continuation of application No. 14/886,275, filed on Oct. 19, 2015, now Pat. No. 9,828,738.

(60) Provisional application No. 62/094,750, filed on Dec. 19, 2014.

(51) Int. Cl.

| | |
|---|---|
| ***E01C 19/00*** | (2006.01) |
| ***E02D 3/046*** | (2006.01) |
| ***E01C 19/32*** | (2006.01) |

(52) U.S. Cl.

CPC ..... *E02D 3/046* (2013.01); *E01C 19/32* (2013.01)

(58) Field of Classification Search

CPC ..... E02D 3/046; E01C 19/32

USPC ..... 404/133.1; 81/489; 173/90

See application file for complete search history.

(56) References Cited

U.S. PATENT DOCUMENTS

| | | | | |
|---|---|---|---|---|
| 947,548 | A * | 1/1910 | Lind | E02D 3/068 404/133.1 |
| 1,019,742 | A | 3/1912 | Boyle et al. | |
| 1,085,505 | A * | 1/1914 | Stafford | E02D 3/068 16/430 |
| 1,704,202 | A * | 3/1929 | MacDougald | E04G 21/066 404/133.1 |
| 2,234,831 | A * | 3/1941 | Porter | E02D 3/046 100/69 |
| 2,299,918 | A * | 10/1942 | Moellenkamp | E02D 3/046 292/256 |
| 2,841,061 | A * | 7/1958 | Starr | E01C 19/32 404/133.1 |
| 2,870,696 | A * | 1/1959 | Yoch | E01C 19/32 404/133.1 |
| 2,988,972 | A * | 6/1961 | Cooper | E01C 19/32 404/133.1 |
| 3,837,024 | A | 9/1974 | Saunders et al. | |

(Continued)

*Primary Examiner* — Raymond W Addie

(74) *Attorney, Agent, or Firm* — Boardman & Clark LLP

(57) ABSTRACT

A tamp having replaceable tamp plates which, when operatively coupled to a tamp handle, can rotate relative to the tamp handle, or a longitudinal axis of the tamp handle, when in use to better allow a tamp plate surface to conform to the material being tamped, while allowing the handle to be more easily maintained in an orientation desired by the user and while reducing or absorbing shock. The tamp may also include "dead blow" material such as steel shot or the like to improve the inertia, efficiency and impact of the tamp as it is being utilized, while reducing recoil effects.

13 Claims, 7 Drawing Sheets

(56) References Cited

U.S. PATENT DOCUMENTS

| | | | | |
|---|---|---|---|---|
| 3,910,738 | A * | 10/1975 | Chandler | B28B 11/0818 404/124 |
| 4,926,947 | A * | 5/1990 | Cozine | A01B 45/023 172/22 |
| 5,244,444 | A | 9/1993 | Wostry | |
| 5,417,517 | A * | 5/1995 | Zollers | E01C 19/402 404/113 |
| 6,904,829 | B2 * | 6/2005 | Krallman | A63B 53/04 81/22 |
| 7,191,685 | B2 * | 3/2007 | Lowther | B21D 1/06 81/27 |
| 8,661,844 | B2 | 3/2014 | Klinkhammer et al. | |
| 9,493,917 | B2 * | 11/2016 | Lesche | E02D 3/046 |
| 2003/0235470 | A1 * | 12/2003 | Gelb | E02D 3/02 404/133.1 |
| 2003/0236470 | A1 * | 12/2003 | Falck, Jr. | A61B 3/16 600/558 |
| 2007/0041787 | A1 * | 2/2007 | Irwin | E01C 19/43 404/133.1 |
| 2014/0193198 | A1 * | 7/2014 | Kropff | E02D 3/046 404/133.1 |
| 2016/0177527 | A1 | 6/2016 | Myrland et al. | |

* cited by examiner

TAMPING TOOL

CROSS-REFERENCE TO RELATED APPLICATIONS

This application claims priority to and is a continuation of U.S. Non-provisional patent application Ser. No. 14/886,275 filed on Oct. 19, 2015, entitled "Tamping Tool," which claims priority to U.S. Provisional Application No. 62/094,750 filed Dec. 19, 2014, entitled "Tamping Tool," the contents of each of which are hereby incorporated by reference in their entirety.

BACKGROUND

The present inventions relate to the field of tamps, tampers and tamping apparatus and assemblies. The present inventions more specifically relate to tampers and tamper tool assemblies for sports fields, landscaping, and construction and maintenance trades.

It is known to provide for tamping tools that may be used for tamping or compacting material. More specifically, tamping tools are used to pack or compress soil material such as soil, sand and clay. For example, tamping tools are utilized to tamp areas of a baseball or softball diamond such as the areas of the pitcher's mound and home plate to maintain these areas (e.g., help keep them firm and consistent). However, existing tamping tools do not realize certain advantageous features (and/or combinations of features).

For example, existing tamping devices are constructed to rigidly secure or fuse the handle relative to the head of the tamp. Often, existing devices even include fins extending from the head toward that handle to help secure the handle relative to the base and to keep or maintain the handle so the head does not move or rotate relative to the handle. Existing devices do not work or adapt well to inclined or uneven surfaces for a number of reasons. For instance, because the handle is rigidly secured relative to the head, when the head is forced into an inclined surface, the handle has a tendency to jerk in the direction of a lower portion of the incline as the head adjusts to meet the inclined surface. This jerking response can cause the tamping device to break and/or jar the user, causing the user stress and fatigue as the user absorbs the jerking or jarring response.

The rigid or fused connection between the tamp head and the handle also prevents the handle from being used with other heads. This is disadvantageous for a number of reasons. For example, when a tamp breaks, the entire device is often scrapped and needs to be completely replaced. In addition, different sized and shaped bases offer advantages over one another. By way of example, all other things being equal, tamp bases with relatively smaller tamping surface areas tend to deliver relatively more compaction force than tamp bases with relatively larger surface areas. Known devices with rigid or fused connections between the handle and base do not allow the use of interchangeable tamp bases of different sizes or shapes, and instead require multiple tamping devices of different sizes.

In addition, existing tamping devices tend to be relatively heavy. Tamp weight is important to effective tamping. The heavier the tamp, the more downward energy tends to be delivered into the material being tamped. However, tamp weight also tends to require additional effort by the user to use and move the tamp, and causes the user additional fatigue.

SUMMARY

It would be desirable to provide a tamper, tamping tool, tamping tool assembly or the like that includes tamping plates which are interchangeable in shape and/or size.

It would also be desirable to provide a tamper, tamping tool, tamping tool assembly or the like that includes tamping plates which may be changed out for purposes of repair or replacement.

It would also be desirable to provide a tamper, tamping tool, tamping tool assembly or the like that includes a tamping plate which is able or configured to adjust, rotate or articulate relative to the handle when in use to better conform the plate surface to the material being tamped while allowing the tamp handle to be more easily maintained in a desired or more vertical orientation.

It would also be desirable to provide a tamper, tamping tool, tamping tool assembly or the like that includes a tamping plate which may rotate relative to the handle to ease reactionary and recoil forces and shock transmitted through the handle to the user to reduce the user's risk and/or significance of injury and/or fatigue.

It would also be desirable to provide a tamper, tamping tool, tamping tool assembly or the like that includes a dampening or absorbing transition between a receiver of the tamping tool and the handle tube to dampen reactionary forces and shock transmitted through the handle to the user to reduce user chances and/or significance of injury and/or fatigue.

It would also be desirable to provide a tamper, tamping tool, tamping tool assembly or the like that includes a tamping handle tube cavity with "dead blow" material, such as steel or lead shot or the like, retained in the cavity to improve the inertia, efficiency and impact of the tamp as it is being utilized, and allow a lighter tamp to generate a comparable compaction force to a relatively heavier tamp with similar effort.

It would also be desirable to provide a tamper, tamping tool, tamping tool assembly or the like that includes a tamping handle tube cavity with "dead blow" material, such as steel or lead shot or the like, retained in the cavity to help dampen the recoil effect and vibration caused when the tamp base meets a surface.

The present disclosure relates to a tamp having a replaceable tamp plate which, when operatively coupled to a tamp handle or tamp handle assembly, can rotate relative to the tamp handle or tamp handle assembly, or a longitudinal axis of the tamp handle or tamp handle assembly, when in use to better conform a tamp plate surface to the material being tamped, while allowing the handle to be more easily maintained in a vertical orientation desired by the user and while reducing or absorbing shock. The tamp may also include "dead blow" material such as steel shot or the like to improve the inertia, efficiency and impact of the tamp as it is being utilized, while reducing recoil effects and forces.

The present disclosure more specifically relates to a tamper tool assembly comprising: a tamp handle having a first end and a second end; and a tamp head coupled to the tamp handle near the second end; wherein the tamp head is configured to articulate relative to the tamp handle near the second end of the tamp handle in response to impact of the tamp head with material being tamped.

The present disclosure more specifically relates to a tamper tool assembly comprising: a tamp head having a first surface and a second surface, and a receiver coupled to the first surface; and an elongated tamp handle provided in a cavity in the receiver and coupled to the receiver; wherein the cavity in the receiver has an interior diameter that is considerably greater than the outside diameter of the tamp handle to provide a sloppy fit between the receiver and the tamp handle to allow the tamp head to rotate relative to the tamp handle in response to impact of the tamp head with material being tamped.

The present disclosure more specifically relates to a tamper tool assembly comprising: a tamp head having a first surface and a second surface, and a receiver coupled to the first surface; and an elongated tamp handle provided in a cavity in the receiver and coupled to the receiver with a connection pin provided through receiver apertures defined in the receiver and handle apertures defined in tamp handle; wherein the handle apertures are sized and/or shaped to maintain a sloppy fit with the connection pin, the sloppy fit permitting rotation of the tamp head relative to the tamp handle in response to impact of the tamp head with material being tamped.

These and other features and advantages of devices, systems, and methods according to this invention are described in, or are apparent from, the following detailed descriptions of various examples of embodiments.

BRIEF DESCRIPTION OF THE DRAWINGS

Various exemplary embodiments of the systems, devices, and methods according to the present disclosure will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Figure 1:
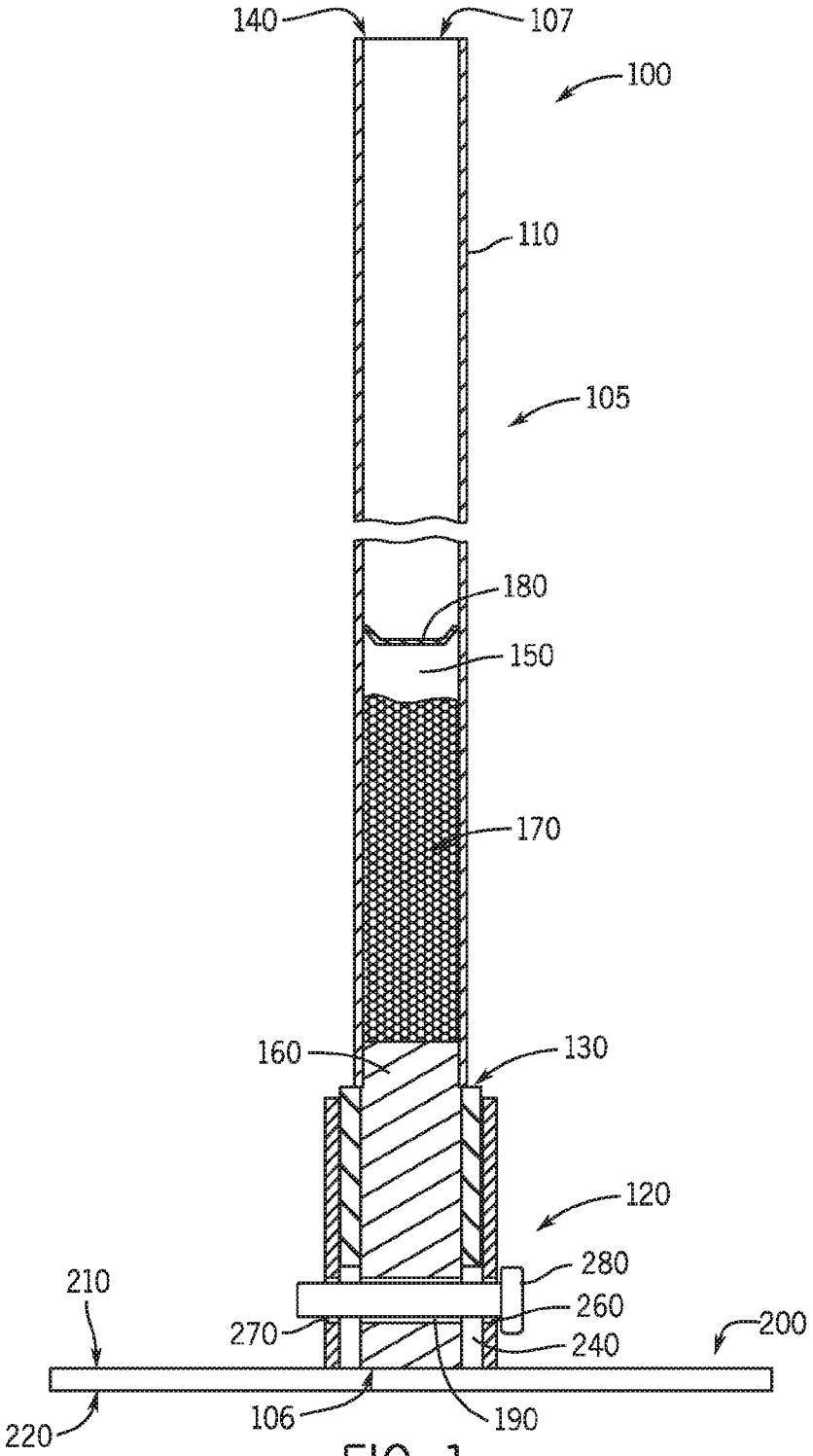
FIG. 1 is a cross-sectional view of a tamping assembly or apparatus according to an exemplary embodiment.

Referring to FIG. 1, in various embodiments, a tamper, tamping tool or apparatus, or tamping assembly 100 is provided. Tamper, tamping tool or tamping assembly 100 includes a tamp handle 105 and a tamp plate, base or head 120.

Figure 2:
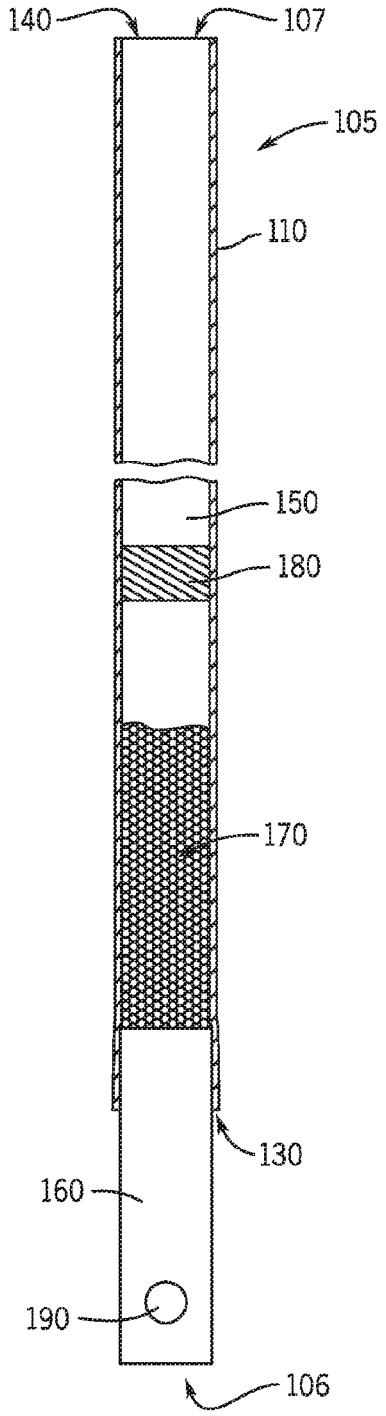
FIG. 2 is a cross-sectional view of a handle of the tamping assembly according to an exemplary embodiment.
Figure 3:
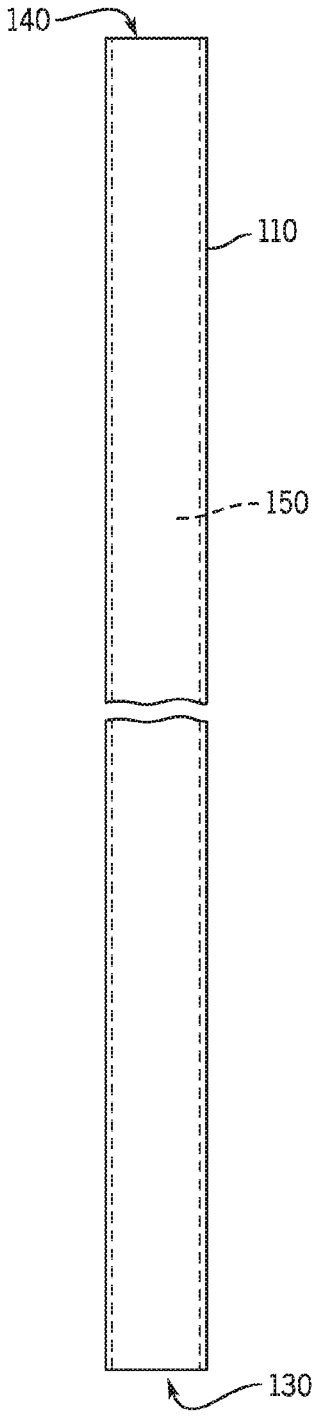
FIG. 3 is a side view of a handle tube of the tamping assembly or apparatus of FIG. 1 according to an exemplary embodiment.
Figure 4:
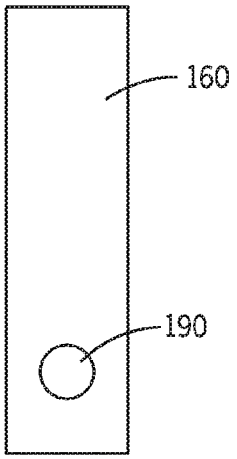
FIG. 4 is a side view of a plug of the tamping assembly or apparatus of FIG. 1 according to an exemplary embodiment.
Figure 5:
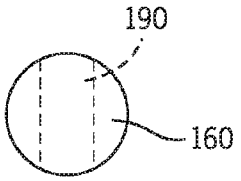
FIG. 5 is a top view of the plug of FIG. 4 according to an exemplary embodiment.

Referring to FIGS. 1 and 2, in various embodiments, tamp handle 105 has opposing first and second handle ends 106 and 107. In various embodiments, tamp handle 105 includes a handle tube 110 having opposing first and second ends 130/140. In various embodiments, handle tube 110 is tubular and defines a handle cavity 150 within handle tube 110. However, it should be appreciated that any variety of cross-sectional shapes and/or sizes may be utilized in the scope of this disclosure. For example, and as shown in FIG. 2, the handle cavity may have a larger or wider dimension near the first opposing end 130 of handle tube 110, compared to other sections or areas of the handle cavity. In addition, while handle cavity 150 is illustrated as extending from opposing first end 130 to opposing second end 140, it should be appreciated that the handle cavity may extend any length between the opposing first and second ends.

Referring again to FIGS. 1 and 2, in various embodiments, tamp handle 110 includes a base plug 160. In various embodiments, base plug 160 is coupled to handle tube 110 and/or provided in handle cavity 150 near first end 130 of handle tube 110. While the FIGURES illustrate the base plug as extending beyond the first opposing end of the handle tube, it should be appreciated that the handle tube may extend further (e.g., the entirety of the tamp handle).

As shown in FIG. 1, handle tube 110 of tamp handle 110 may be substantially consistent in internal diameter. As shown in FIG. 2, the internal diameter or dimension of handle tube 110 of tamp handle 110 may vary along its length. For example, as shown in FIG. 2, the internal diameter of handle tube 110 may be greater or wider near first end 130 to better receive base plug 160 while providing a physical stop for base plug 160 in first end 130.

In various examples of embodiments, base plug 160 is adapted to help hold or retain a mass of "dead blow" or flowable material 170, such as lead or steel shot, within handle cavity 150 defined by handle tube 110. In various embodiments, the tamp handle retains up to two pounds of "dead blow" material within the handle cavity. In various embodiments, the tamp handle cavity retains one and one-half pounds of "dead blow" material. In various embodiments, the mass of flowable or "dead blow" material and the handle cavity are is configured to allow the mass of flowable or "dead blow" material to move or shift within the handle cavity so that when the tamping device is driven or forced into material to be tamped, the dead blow material will shift in the direction of the tamp head and/or the material being tamped to generate additional tamping or compaction force and/or prevent or diminish recoil of the tamping device.

In various embodiments, a crown plug 180 is also provided in handle cavity 150 of handle tube 110 between "dead blow" material 170 and opposing second end 140 of handle tube 110 to help retain "dead blow" material 170 within handle cavity 150 defined by tamp handle 110. Alternatively, the handle cavity may simply terminate between the opposing second end of the handle tube and the flowable material provided within the handle cavity. The crown plug can be any material including steel or silicone.

Referring now to FIGS. 1-2 and 4-5, in various embodiments, plug or base plug 160 defines a plug aperture 190 extending through plug or base plug 160. While plug or base plug 160 is illustrated in the FIGS. 1 and 2 as, with the exception of plug aperture 190, a solid or mostly solid plug or base plug 160, extending from, through, or near first end 130 of handle tube 110, the plug or base plug need not be a solid piece of material. For example, the plug or base plug may be hollow or partially hollow.

Figure 6:
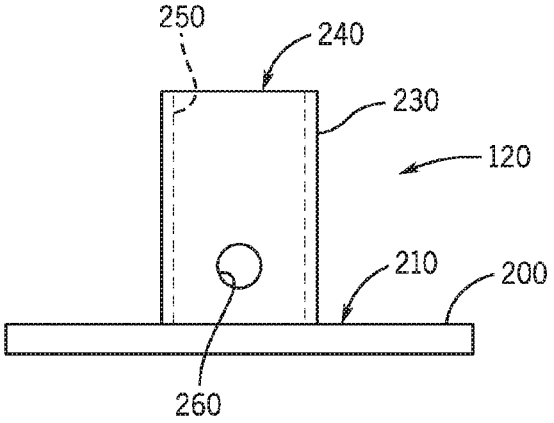
FIG. 6 is a side view of a tamp plate of the tamping assembly or apparatus of FIG. 1 according to an exemplary embodiment.
Figure 7:
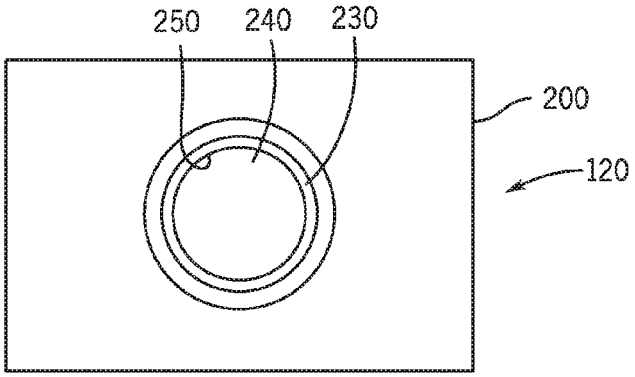
FIG. 7 is a top view of the tamp plate of FIG. 6 and a dampening or absorbing transition or member, according to an exemplary embodiment.

Referring now to FIGS. 1 and 6-7, in various embodiments, tamp plate 120 includes a base member 200 having a first face or surface 210 and a second face or surface 220 (e.g., substantially planar surface).

Tamp plate 120 is illustrated as having a square profile (e.g., having an eight inch by eight inch dimension). It should be appreciated that the tamp plate may have or encompass any variety of profile shapes, including circular, triangular, rectangular, etc., and any variety of sizes (e.g., six inch×four inch, six inch×six inch, ten inch×ten inch, etc.), as shown in FIG. 8.

In various embodiments, tamp plate 120 includes a receiver 230 coupled to and projecting out from first surface 210 of base member 200 of tamp plate 120. In various embodiments, receiver 230 defines an interior receiver cavity 240 defined by one or more cavity walls 250. In various embodiments, interior receiver cavity 240 has an interior diameter. In various embodiments, cavity wall 250 of receiver 230 defines opposing receiver apertures 260/270. While FIGS. 1 and 6-7 illustrate receiver 230 as having a circular or annular cross section, it should be appreciated that the receiver may take any variety of shapes or cross-sectional shapes.

Figure 8:
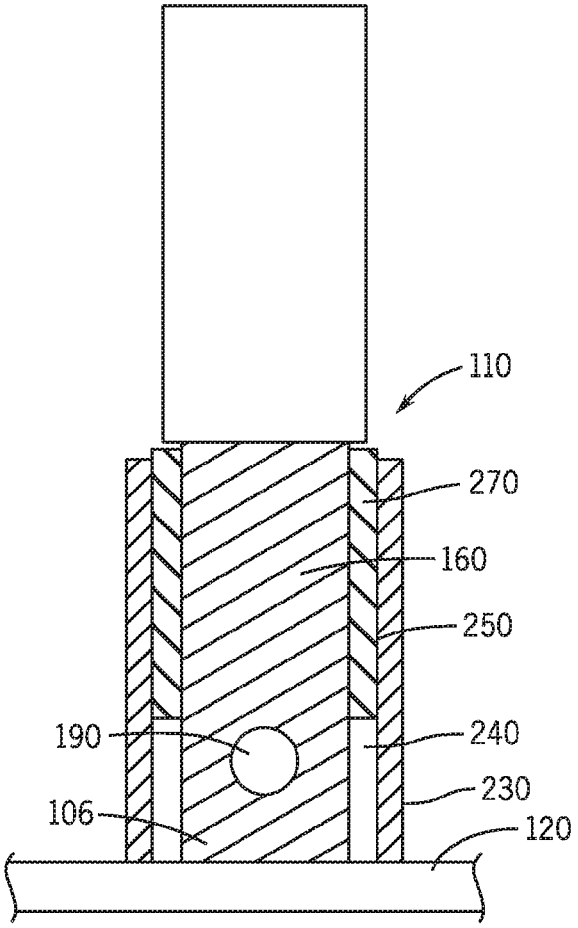
FIG. 8 is a partial cross-sectional view of the tamp handle, tamp plate and a dampening or absorbing transition or member, according to an exemplary embodiment.

Referring now to FIGS. 1 and 8, in various embodiments, receiver cavity 240 is adapted to receive opposing first handle end 106 of tamp handle 110. In various embodiments, the interior diameter of interior receiver cavity 240 is considerably greater than an outside diameter of tamp handle 110 and/or base plug 160. In various embodiments, receiver cavity 240 is adapted or configured to loosely receive opposing first handle end 106 (or base plug 160) of tamp handle 110. In various embodiments, tamp handle 110 (or more specifically base plug 160) is provided in receiver cavity 240 in a spaced relation to one or more cavity walls 250 helping defining receiver cavity 240.

In various embodiments, receiver 230 is coupled or provided about opposing first handle end 106 of tamp handle 110. In various embodiments, opposing first handle end 106 of tamp handle 110 is coupled to or otherwise provided in receiver cavity 240 defined by receiver 230.

Figure 9:
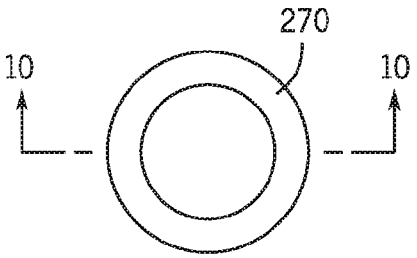
FIG. 9 is a top view of the dampening or absorbing transition or member illustrated in FIG. 8, according to an exemplary embodiment.
Figure 10:
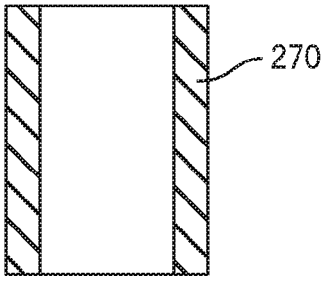
FIG. 10 is a sectional view of the dampening or absorbing transition or member illustrated in FIG. 9, according to an exemplary embodiment.
Figure 11:
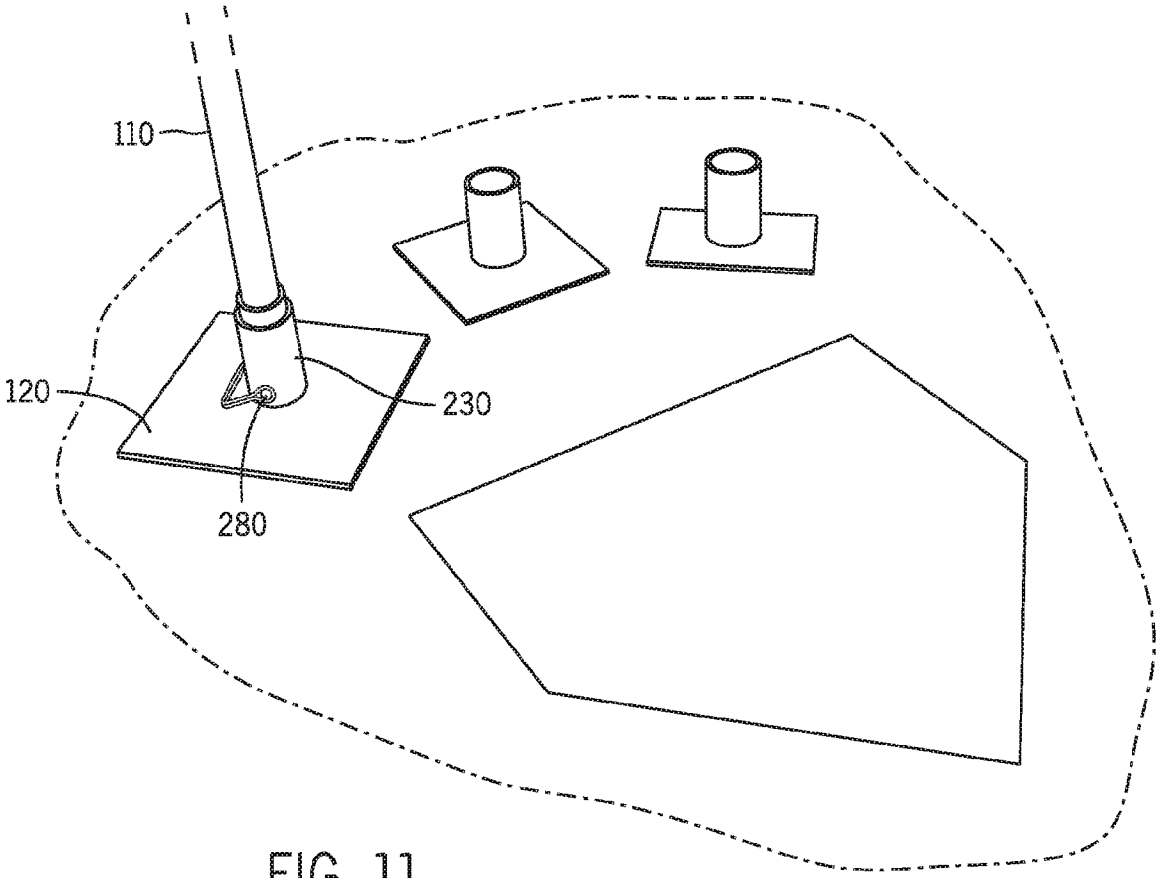
FIG. 11 is a perspective view of a tamping assembly or apparatus with a variety of tamp plates, according to various exemplary embodiments.

Referring now to FIGS. 8-10, a dampening or absorbing transition or member 270 such as a molded rubber, rubber tube or one or more O-rings (e.g., stacked O-rings) or the like may be provided between tamp handle 110 (and/or base plug 160) and cavity wall(s) 250 of receiver 230 helping define receiver cavity 240. In various embodiments, dampening or absorbing transition or member 270 is adapted to help dampen reactionary forces and shock transmitted through the handle or handle tube to a user (e.g., to reduce user chances and/or significance of injury and/or fatigue when the tamping tool is in use). In various embodiments, dampening or absorbing transition or member 270 is adapted to help maintain tamp handle 110 relative to tamp plate 120 while still allowing tamp handle 110 to move, rotate or articulate relative to tamp plate 120, and/or to allow tamp plate 120 to move, rotate, or articulate relative to tamp handle 110.

In various embodiments, receiver 230 projecting out from first surface 210 of tamp plate 120 is adapted or configured to be provided around or otherwise receive first handle end 106 of tamp handle 110 such that the one or more opposing apertures 260/270 of receiver 230 generally align with aperture 190 defined in plug 160. Referring again to FIG. 1, in various embodiments, tamping tool assembly 100 also includes a connection member 280 such as a cross pin or bolt that may be inserted through aperture 190 defined by plug 160, and opposing apertures 260/270 defined by receiver 230 to help operatively and releasably couple tamp plate 120 to tamp handle 110. In various embodiments, one or more apertures 190/260/270 are oversized in cross-sectional dimension(s) relative to the dimension(s) or cross-sectional dimension(s) of connection member 280.

The tamp handle may be made of any appropriate materials, including steel, fiberglass, or another polymer material. In various embodiments, the receiver, plug, and tamp plate are made of steel, such as tool steel. In various embodiments, the dampening or absorbing transition or member is made of a dampening or shock absorbent material such as a shock absorbing polymer or rubber.

Referring to FIGS. 11 and 12A-12C, in operation, receiver 230 of tamp plate 120 of a desired or pre-determined size receives or is otherwise provided around and operatively coupled to the base plug and/or the first end of tamp handle 110 by providing connection member or cross pin 290 through the aligned aperture defined in the plug and the apertures defined in receiver 230. In various embodiments, clearance between the plug and/or the first end of the tamp handle, and the inside diameter of the cavity of the receiver and/or the "sloppy" fit between the connection member or cross pin and the apertures defined in the base plug and/or receiver and adapted to receive the member or cross pin allow the tamp handle, which may be set approximately at about a nominal ninety degree angle to the second surface of the tamp plate, to articulate or rotate relative to the second surface of the tamp plate in various directions.

Figure 12A:
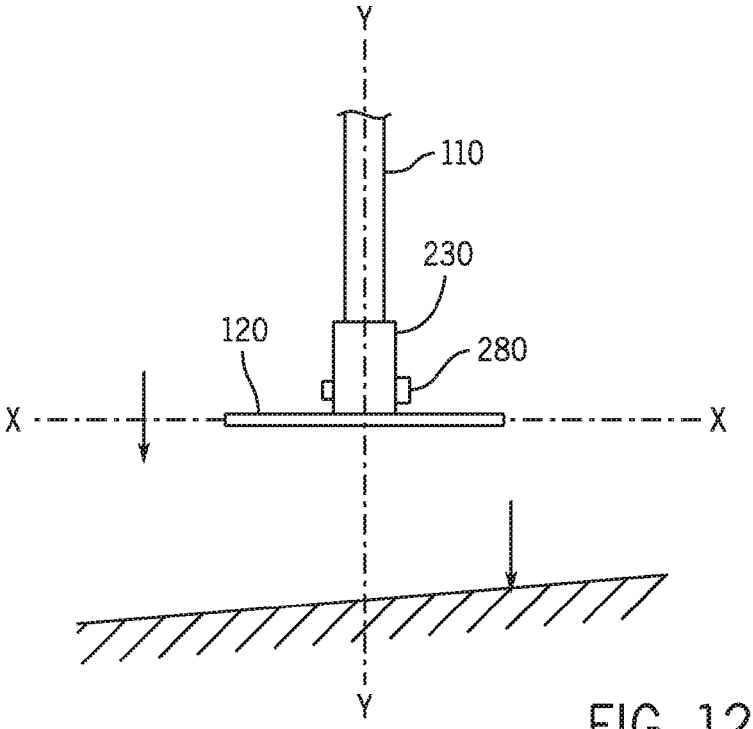
FIG. 12A is a side view of a tamping assembly or apparatus at a first position relative to an inclined surface, according to various examples of embodiments.
Figure 12B:
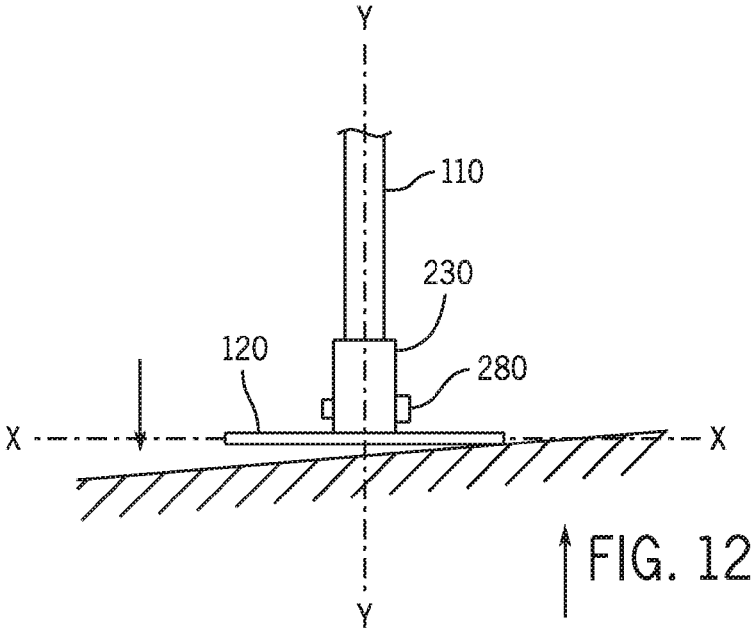
FIG. 12B is a side view of a tamping assembly or apparatus at a second position relative to an inclined surface, according to various examples of embodiments.
Figure 12C:
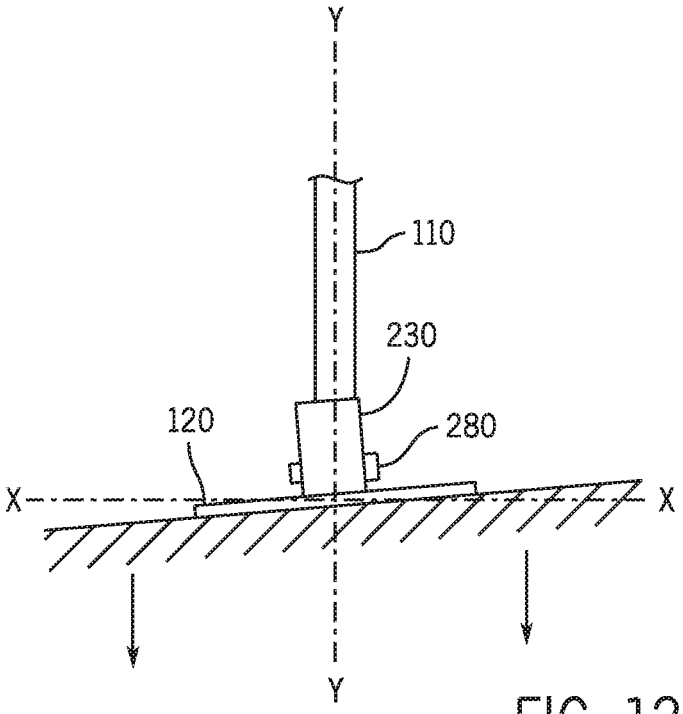
FIG. 12C is a side view of a tamping assembly or apparatus at a third position relative to an inclined surface, according to various examples of embodiments.

In various embodiments, the loose or sloppy fit between the interior diameter or dimension of the plug aperture relative to the outer diameter or dimension of the cross pin, and/or the loose or sloppy fit between the interior diameter or dimension of the receiver cavity and the outer diameter of the first opposing end of the tamp handle and/or plug allows for articulation between the handle or handle tube and the receiver and/or tamp plate of the base member. More specifically, as a result of the disclosed arrangement, and with the inclusion of the dampening or absorbing transition or member, in various embodiments, receiver 230 articulates or rotates relative to or about a longitudinal axis Y-Y of tamp handle 110 up to ten degrees (e.g., from zero to ten degrees in any direction) from the longitudinal axis Y-Y as shown in FIG. 12C, and/or tamp plate 120 and/or the second surface of tamp plate 120 articulates or rotates relative to or about an axis X-X perpendicular to the longitudinal axis Y-Y. In various embodiments, the receiver (or a longitudinal axis of the receiver) articulates or rotates up to six degrees (e.g., from zero to six degrees in any direction) from the longitudinal axis Y-Y of tamp handle 110. In various embodiments, tamp plate 120 (and/or the second surface of tamp plate 120 or a plane extending therethrough) articulates or rotates relative to or about the axis X-X up to six degrees from the axis X-X.

In various embodiments, rotation or articulation of tamp plate 120 or the second surface of tamp plate 120 relative to handle 110 allows tamp plate 120 or the second surface to adjust to terrain, ground or other material (e.g., irregular, uneven, or inclined terrain, ground or other material) when tamp plate 120 is moved or accelerated into or toward the terrain, ground or other material (e.g., with handle 110 or longitudinal axis of handle 110 at a substantially vertical orientation) to allow tamp plate 120 or the second surface to adapt to that terrain, ground or other material without forcing handle 110 to make the same or a fully corresponding adaption. In various embodiments, the dead blow material loosens as the tamp is accelerated toward the ground, but shifts or accelerates toward the ground, plug and/or tamp plate as or after the plate hits the ground to hit the plug and add additional inertia to the tamp plate into the ground, and/or reduce recoil.

The loose or sloppy fit between the interior diameter or dimension of the plug aperture relative to the cross pin, in combination with the position of the tamp handle relative to the tamp plate, also helps reduce stresses on the cross pin during tamping or other use. In various embodiments, when the tamper is lifted or moved away from material (e.g., clay) to be tamped, the cross pin engages a portion of the plug defining the plug aperture. In various embodiments, however, when the tamper is forced downward toward or into material (e.g., clay) to be tamped, the arrangement allows first opposing end of tamp handle to contact the tamp plate (e.g., the first opposing surface of tamp plate) before another portion of the plug helping define the plug aperture contacts the cross pin.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the FIGURES. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the tamping assembly or apparatus as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various exemplary embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A tamper tool assembly comprising:

a tamp head having a first surface and a second surface, and a receiver coupled to the first surface; and an elongated tamp handle provided in a cavity defined by the receiver and coupled to the receiver with a connection member provided through at least one receiver aperture defined in the receiver and at least one handle aperture defined in tamp handle;

whereby the handle apertures and/or the receiver apertures are sized and/or shaped to maintain a sloppy fit with the connection member, the sloppy fit helping allow movement, rotation or articulation of the tamp head relative to the tamp handle in any direction.

2. The tamper tool assembly of claim 1, whereby the tamp handle defines a tamp handle cavity therein and flowable material is retained in the tamp handle cavity.

3. The tamper tool assembly of claim 2, whereby the flowable material is metal shot.

4. The tamper tool assembly of claim 1, whereby the tamp head is configured to move, rotate or articulate up to ten degrees relative to the tamp handle in response to impact of the tamp head with material being tamped.

5. The tamper tool assembly of claim 1, whereby the tamp handle is provided in the receiver cavity in a spaced relation to one or more cavity walls helping define the cavity, and attached to the receiver; whereby a dampening transition member is provided between the one or more cavity walls and the tamp handle; and whereby the spaced relation and the dampening transition member provided between the tamp handle and one or more cavity walls also allows the tamp head to move, rotate or articulate in any direction relative to the tamp handle.

6. A tamper tool assembly comprising:

a tamp head having a first surface and a second surface, and a receiver coupled to the first surface; and an elongated tamp handle provided in a cavity defined by the receiver and coupled to the receiver with a connection member provided through one or more receiver apertures defined in the receiver and one or more handle apertures defined in tamp handle;

whereby the handle apertures and/or the receiver apertures are sized and/or shaped to maintain a sloppy fit with the connection member, the sloppy fit helping allow the tamp handle to contact the tamp head before the connection member contacts the receiver apertures and handle apertures, in response to impact of the tamp head with material being tamped.

7. The tamper tool assembly of claim 6, whereby the sloppy fit also helps allow movement, rotation or articulation of the tamp head relative to the tamp handle in any direction.

8. The tamper tool assembly of claim 6, whereby the tamp handle defines a tamp handle cavity therein and flowable material is retained in the tamp handle cavity.

9. The tamper tool assembly of claim 8, whereby the flowable material is metal shot.

10. A tamper tool assembly comprising:

a tamp head having a first surface and a second surface, and a receiver coupled to the first surface; and an elongated tamp handle provided in a cavity defined by the receiver and coupled to the receiver with a connection member provided through one or more receiver apertures defined in the receiver and one or more handle apertures defined in tamp handle;

whereby an interior dimension of the handle apertures and/or the receiver apertures is oversized relative to a cross-sectional dimension of the connection pin to allow the tamp handle to contact the tamp head before the connection member contacts the receiver apertures and handle apertures, in response to impact of the tamp head with material being tamped.

11. The tamper tool assembly of claim 10, whereby the oversized interior dimension of the handle apertures and/or the receiver apertures relative to the cross-sectional dimension of the connection pin also helps allow movement, rotation or articulation of the tamp head relative to the tamp handle in any direction.

12. The tamper tool assembly of claim 10, whereby the tamp handle defines a tamp handle cavity therein and flowable material is retained in the tamp handle cavity.

13. The tamper tool assembly of claim 12, whereby the flowable material is metal shot.

* * * * *